US008162720B2

(12) United States Patent
Tzeng

(10) Patent No.: US 8,162,720 B2
(45) Date of Patent: Apr. 24, 2012

(54) APPARATUS AND METHOD FOR POLISHING VIA DRIVING ABRASIVE GRAINS MECHANICALLY AND MAGNETICALLY

(75) Inventor: Hsinn-Jyh Tzeng, Tainan County (TW)

(73) Assignee: Southern Taiwan University, Tainan County (TW)

( * ) Notice: Subject to any disclaimer, the term of this patent is extended or adjusted under 35 U.S.C. 154(b) by 401 days.

(21) Appl. No.: 12/071,164

(22) Filed: Feb. 15, 2008

(65) Prior Publication Data

US 2010/0136887 A1 Jun. 3, 2010

(30) Foreign Application Priority Data

Sep. 20, 2007 (TW) ..... 096135218 A

(51) Int. Cl.
*B24B 31/112* (2006.01)

(52) U.S. Cl. ..... 451/11; 451/113

(58) Field of Classification Search ..... 451/11, 451/104, 106, 113, 327
See application file for complete search history.

(56) References Cited

U.S. PATENT DOCUMENTS 2,735,231 A * 2/1956 Simjian ..... 451/113
2,735,232 A * 2/1956 Simjian ..... 451/113
7,217,173 B1 * 5/2007 Yan et al. ..... 451/36
7,291,060 B2 * 11/2007 Yan et al. ..... 451/113

* cited by examiner

*Primary Examiner* — Robert Rose
(74) *Attorney, Agent, or Firm* — Jackson IPG PLLC; Demian K. Jackson

(57) ABSTRACT

Disclosed is a polishing apparatus including a shell, a magnetic controller, an axle, a pusher, a ring, posts, and a stirring element. The shell includes a roof, a floor and a wall between the roof and the floor. Abrasive solution is filled in the shell. The abrasive solution includes abrasive grains and magnetic material. The magnetic controller is located around the wall. The axle can be engaged with a rotary element of a machine. The pusher is connected to the axle and inserted through the roof. A ring is located between the pusher and the wall. Posts are located between the ring and the floor. The stirring element is located on the floor.

7 Claims, 4 Drawing Sheets

APPARATUS AND METHOD FOR POLISHING VIA DRIVING ABRASIVE GRAINS MECHANICALLY AND MAGNETICALLY

FIELD OF THE INVENTION

The present invention relates to an apparatus and method for polishing and, more particularly to an apparatus and method for polishing via driving abrasive grains mechanically and magnetically.

DESCRIPTION OF THE RELATED ARTS

Micro-electromechanical systems, roller-guiding threaded bolts of precision machines lifting or steering mechanisms in the aerospace industry, transmissions of vehicles and precision measuring instruments draw a lot of attention. For these systems, machines, mechanisms and instruments, it is important to efficiently and precisely make threaded elements with complicated surfaces such as precision transmitting threaded bolt and miniature threaded bolts.

In the ammunition industry it is crucial to remove shag from precision threaded bolts for use in steering or lifting mechanisms for gun barrels. It is however difficult to polish such threaded bolts and, more particularly, threaded bolts with complicated surfaces. It takes a lot of time to polish such threaded bolts. The lengths of such threaded bolts that can be polished are limited.

In 2002, Mr. Da et al. proposed metal-less adhering abrasive grains for use in an apparatus and method for electrolytic polishing. Abrasive grains are used the carbon-containing metal-less combination portion of each of the abrasive grains is kept, and electrolysis is used to achieve high polishing efficiencies and good effects. This conventional apparatus and method however cannot effectively or efficiently remove shags from threaded bolts with complicated surfaces.

In 2004, on the International Journal of Machine Tool and Manufacture, Volume 44, pages 201 to 211, V. K. Gorana et al. discussed impacts on the removal ratio of shag, the roughness of work pieces, cutting forces and the density of abrasive grains by the pressure on abrasive grains, the concentration of the abrasive grains and the sizes of the abrasive grains. Parameters such as the sizes of the abrasive grains, the types of the abrasive grains, the concentration of the abrasive grains, time for processing and the materials of the work pieces were considered. Due to the pressure, the abrasive grains were reciprocated on the work pieces, thus removing the shag from the work pieces and reducing the roughness of the work pieces. This conventional method however cannot effectively or efficiently remove shag from threaded bolts with complicated surfaces.

In 2004, on the International Journal of Machine Tool and Manufacture, Volume 44, pages 1019 to 1029, V. K. Jain et al. disclosed a method for polishing via combining abrasive grains with electro-magneto rheological. Impacts on the roughness of work pieces and the ratio of the removal of shag from the work pieces by various recipes of the abrasive grains are studied. Moreover, rotary magnetic poles are used to drive magnetic abrasive grains, and impacts on the roughness of the work pieces and the ratio of the removal of the shag from the work pieces by the shapes of the magnetic poles and the rate of the rotation of the magnetic poles were studied. This conventional method however cannot effectively or efficiently remove shag from threaded bolts with complicated surfaces.

The present invention is therefore intended to obviate or at least alleviate the problems encountered in prior art.

SUMMARY OF THE INVENTION

It is an objective of the present invention to provide an effective and efficient apparatus for polishing.

It is another objective of the present invention to provide an environmentally friendly apparatus for polishing.

To achieve the foregoing objectives, there is provided an apparatus for polishing via driving abrasive grains mechanically and magnetically according to the present invention. The polishing apparatus includes a shell, a magnetic controller, an axle, a pusher, a ring, posts, and a stirring element. The shell includes a roof, a floor and a wall between the roof and the floor. Abrasive solution is filled in the shell. The abrasive solution includes abrasive grains and magnetic material. The magnetic controller is located around the wall. The axle can be engaged with a rotary element of a machine. The pusher is connected to the axle and inserted through the roof. A ring is located between the pusher and the wall. Posts are located between the ring and the floor. The stirring element is located on the floor.

Other objectives, advantages and features of the present invention will become apparent from the following description referring to the attached drawings.

BRIEF DESCRIPTION OF THE DRAWINGS

The present invention will be described via the detailed illustration of the preferred embodiment referring to the drawings.

DETAILED DESCRIPTION OF EMBODIMENT

Figure 1:
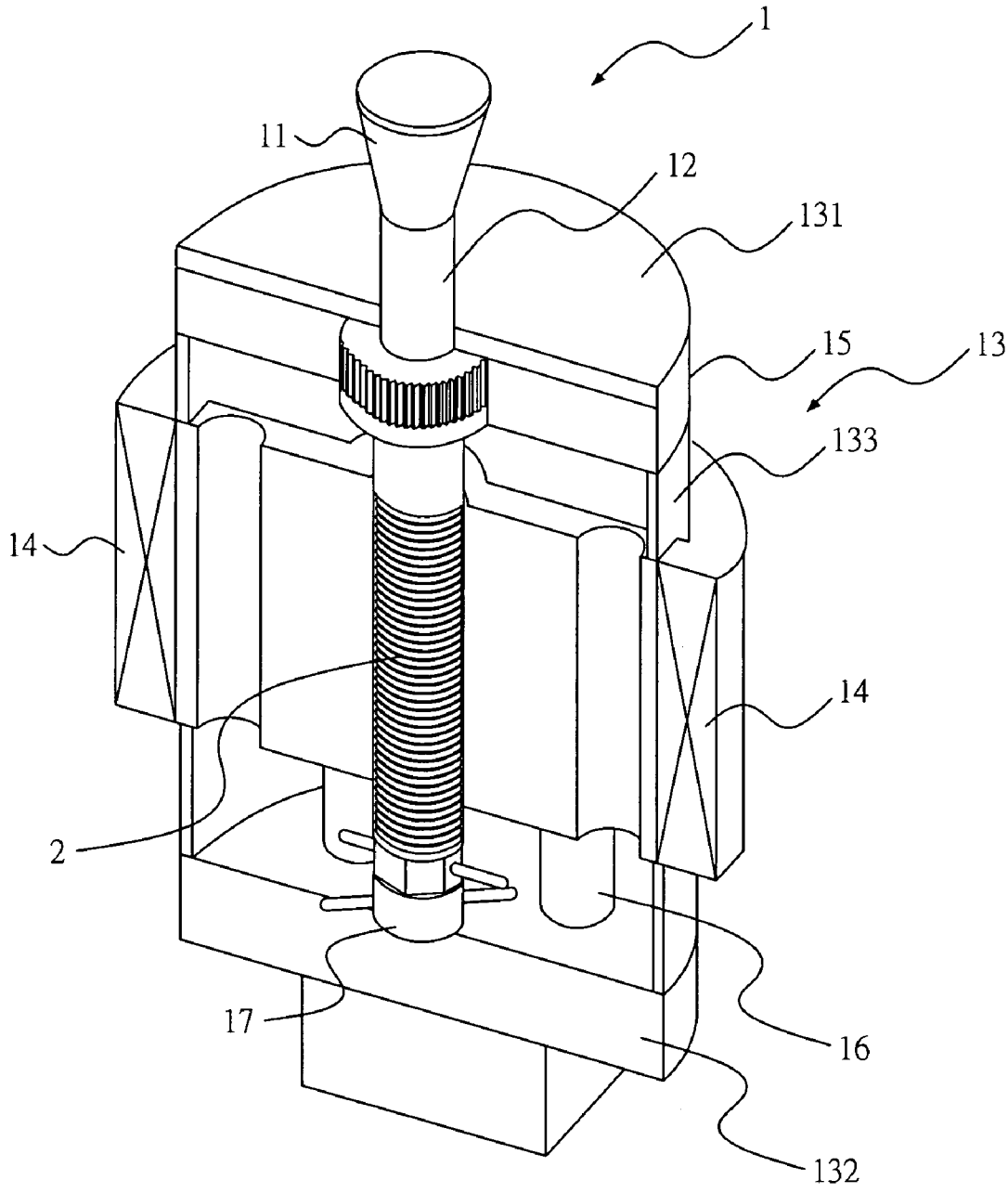
FIG. 1 is a cut-away view of an apparatus for polishing via driving abrasive grains mechanically and magnetically according to the preferred embodiment of the present invention.

Referring to FIG. 1, there is shown an apparatus 1 for polishing a work piece 2 by driving abrasive grains mechanically and magnetically according to the preferred embodiment of the present invention. The apparatus includes an axle 11, a pusher 12, a shell 13, a magnetic controller 14, a ring 15, two posts 16 and a stirring element 17. The work piece 2 is a threaded bolt.

Figure 2:
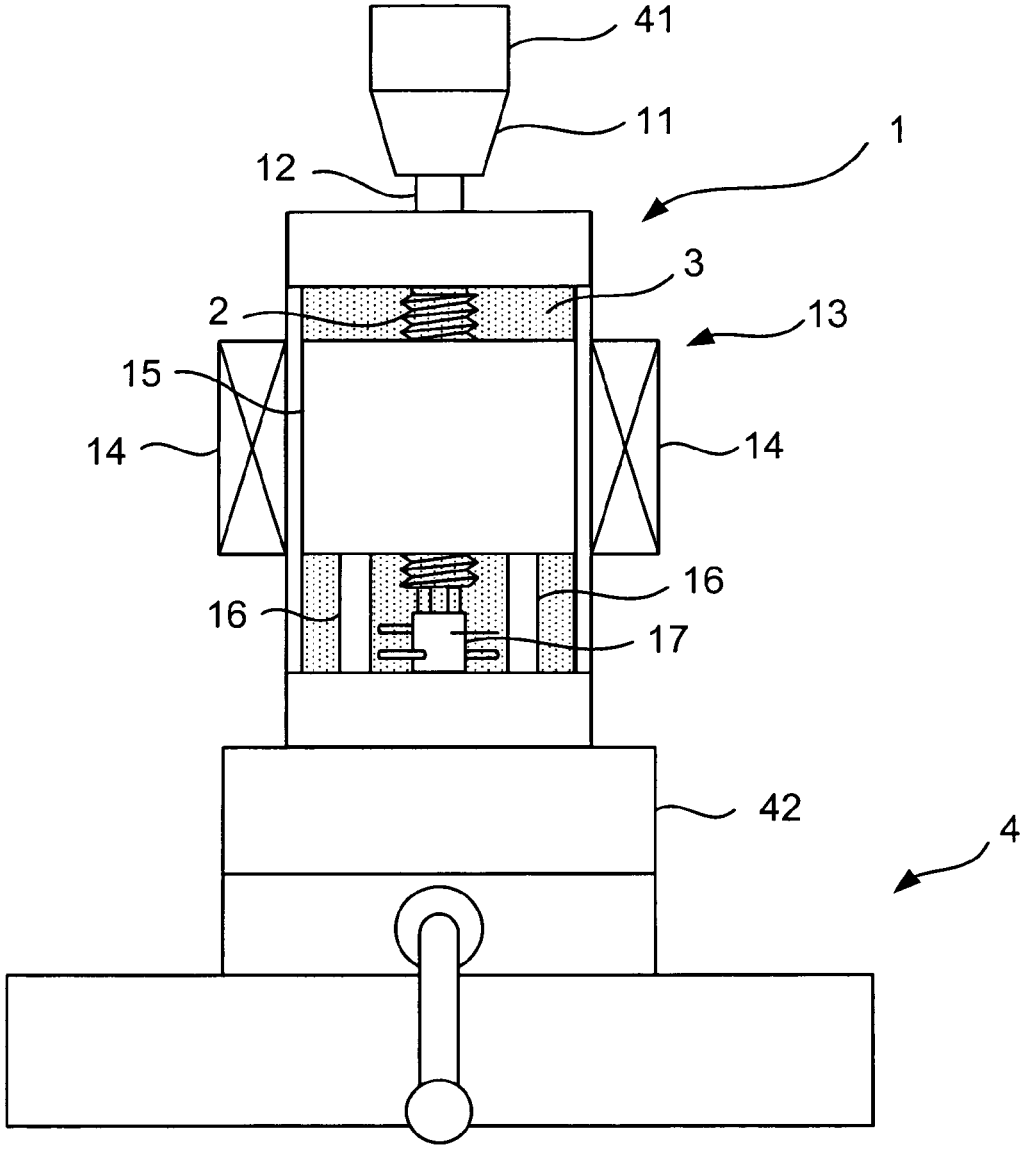
FIG. 2 is front view of the apparatus shown in FIG. 1.

Referring to FIG. 2, the apparatus is used together with a machine 4. The machine 4 includes a rotary element 41 and a platform 42. The apparatus 1 is located between the rotary element 41 and the platform 42. The machine 4 may be a traditional milling machine or a computer numerical control milling machine.

The shell 13 includes a roof 131, a floor 132 and a wall 133 provided between the roof 131 and the floor 132. The roof 131 is preferably an annular element. The shell 13 is made of a ferromagnetic or non-ferromagnetic metal.

Abrasive solution 3 is filled in the shell 13 during the polishing of the work piece 2. The abrasive solution 3 may include grease or lubricating oil, magnetic material and abrasive grains. Alternatively, the abrasive solution 3 may include silicon oil, wax, magnetic material, polymeric glue and abrasive grains. The abrasive grains are made with various sizes.

The abrasive grains are made of silicon carbide or any other proper material. A thermometer may be disposed in the shell 13.

The magnetic controller 14 is located around the wall 133 of the shell 13. The magnetic controller 14 is preferably an electromagnet.

The axle 11 is located outside the roof 131 of the shell 13. An upper end of the axle 11 can be engaged with the rotary element 41 of the machine 4.

The pusher 12 is movably inserted through and connected to the roof 131 of the shell 13. An upper end of the pusher 12 is connected to a lower end of the axle 11.

The ring 15 is used between the pusher 12 and the wall 133 of the shell so that the pusher 12 is retained in position. There is a gap between the ring 15 and the pusher 12, and this gap is called the "fabrication gap". A bearing or bushing may be used between the pusher 12 and the ring 15. The bearing is preferably a ball bearing. The size and shape of the internal side of the ring 15 is determined according to the work piece 2.

The posts 16 are provided on the floor 132 of the shell 13. The ring 15 is supported on the post 16.

The stirring element 17 is rotationally provided on the floor 132 of the shell 13. The stirring element 17 includes blades or rods for stirring. A bearing or bushing may be used between the stirring element 17 and the floor of the shell 13.

Figure 3:
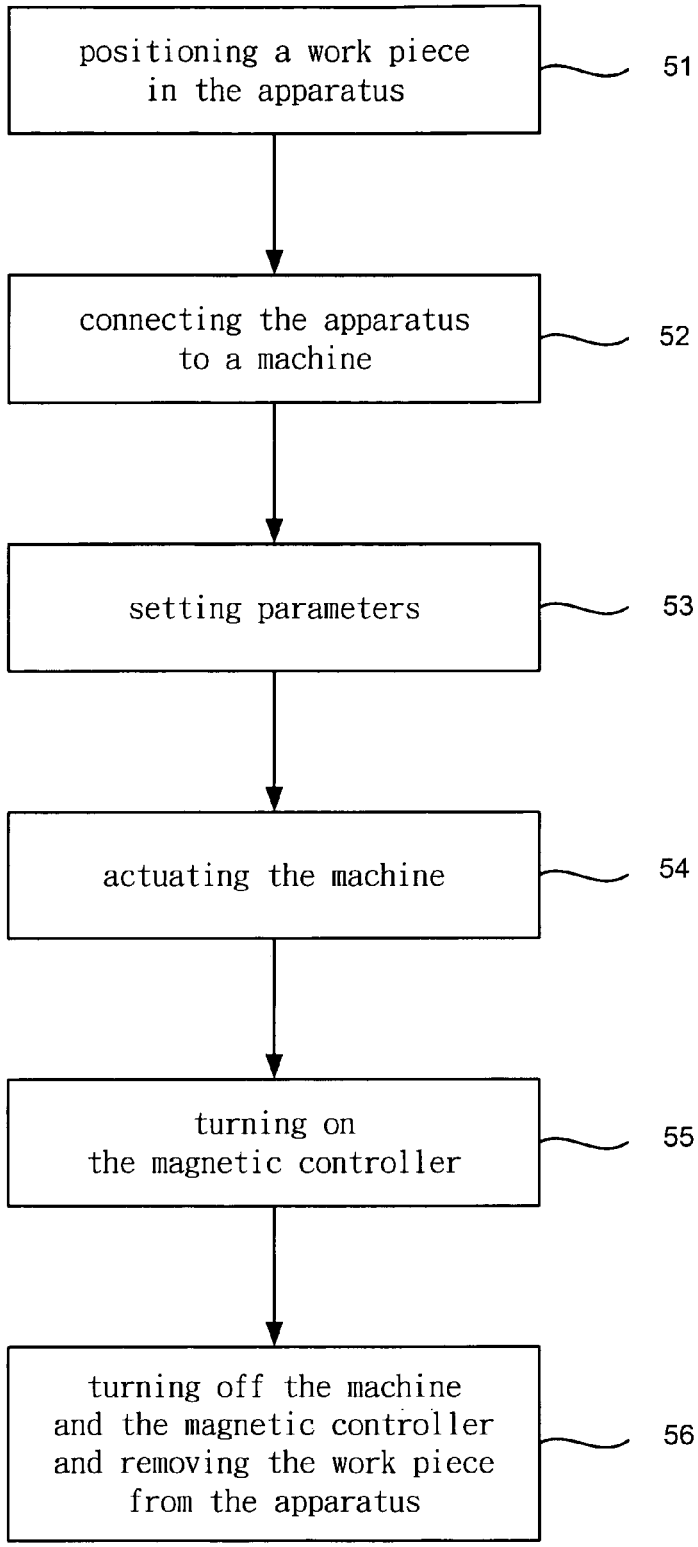
FIG. 3 is a flow chart of a method executed in the apparatus of FIG. 1.
Figure 4:
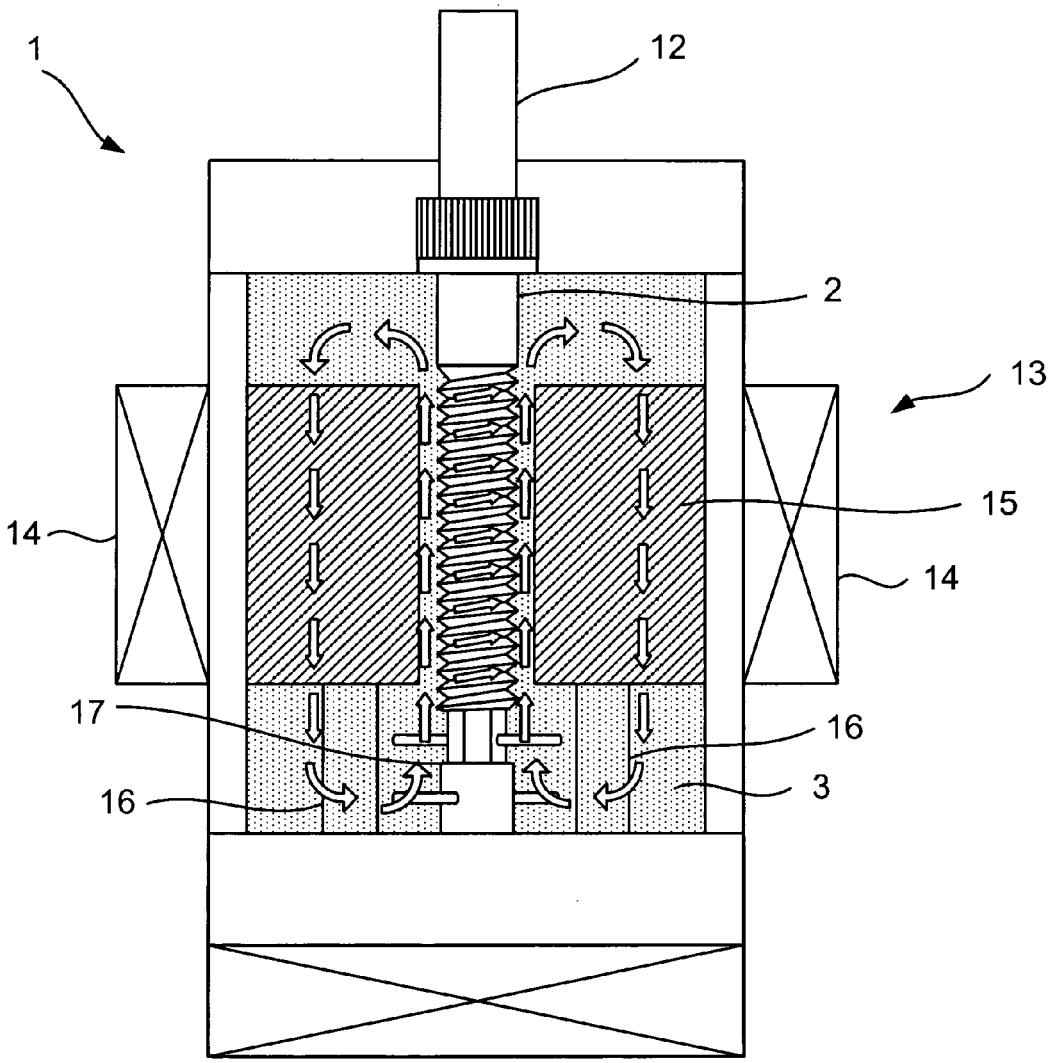
FIG. 4 is a cross-sectional view of the apparatus shown in FIG. 1.

The polishing of the work piece 2 with the apparatus 1 will be described referring to FIGS. 2 to 4.

At 51, the work piece 2 is inserted through the ring 15 and located between the posts 16. The work piece 2 is provided between the pusher 12 and the stirring element 17. The work piece is firmly positioned by moving the pusher 12 towards to the stirring element 17. The abrasive solution 3 is filled in the shell 13.

At 52, the floor 132 of the shell 13 of the apparatus 1 is supported on the platform 42 of the machine 4. The axle of the apparatus 1 is engaged with the rotary element 41 of the machine 4.

At 53, parameters are set. The parameters include the material and sizes of the abrasive grains, the concentration of the abrasive grains in the abrasive solution 3, the size and shape of the internal side of the ring 15, the type and rotational rate of the stirring element 17, the fabrication gap and the fabrication time.

At 54, the machine 4 is actuated. The rotary element 4 of the machine 4 rotates the axle 11 of the apparatus 1 so that the pusher 12 rotates the work piece 2. In turn, the work piece 2 rotates the stirring element 17. The work piece 2 and the stirring element stir the abrasive solution 3 so that the abrasive solution 3 polishes the work piece 2. At first, the viscosity of the abrasive solution 3 is high. As the stirring of the abrasive solution 3 goes on the viscosity of the abrasive solution 3 drops.

At 55, the magnetic control 14 is turned on to provide a magnetic field. The polarity of the magnetic field is changed repeatedly. Thus, the changing magnetic field causes the magnetic material in the abrasive solution 3 to move. The moving magnetic material in the abrasive solution 3 enhances the polishing of the work piece 2 by the abrasive solution 3.

At 56, the machine 4 and the magnetic controller 14 are turned off. The work piece 2 is removed from the apparatus 1.

As discussed above, the work piece and the stirring element 17 stir the abrasive solution 3 so that the abrasive solution 3 removes shag and dirt from the work piece 2. The polishing of the work piece 2 occurs. In addition, the magnetic controller 14 causes the magnetic material in the abrasive solution 3 to move, thus enhancing the polishing of the work piece 2.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A polishing apparatus comprising:

a shell made of non-ferromagnetic metal and comprising a roof, a floor and a wall between the roof and the floor;

abrasive solution comprising abrasive grains and magnetic material and filled in the shell;

an electromagnet magnetic controller located around the wall and providing alternating polarity electromagnetically driven alternating movement to the abrasive solution;

an axle for engagement with a rotary element of a machine;

a pusher connected to the axle and inserted through the roof;

a ring located between the pusher and the wall;

posts located between the ring and the floor; and a stirring element located on the floor and providing mechanically driven movement to the abrasive solution.

2. The polishing apparatus according to claim 1, wherein the roof, the floor and the wall are circular.

3. The polishing apparatus according to claim 1, wherein the abrasive grains are made of silicon carbide.

4. The polishing apparatus according to claim 1, wherein the abrasive solution comprises a material selected from a group consisting of grease and lubrication oil.

5. The polishing apparatus according to claim 1, wherein the abrasive solution comprises silicon oil, wax and polymeric glue.

6. A polishing method using the polishing apparatus in accordance with claim 1 comprising the steps of:

inserting a work piece through the ring, locating the work piece between the pusher and the stirring element and positioning the work piece by moving the pusher towards the stirring element;

providing the floor of the shell on a platform of the machine;

connecting the axle to the rotary element of the machine;

setting parameters;

actuating the machine so that the rotary element rotates the axle of the apparatus that in turn rotates the pusher that in turn rotates the work piece that in turns rotates the stirring element for stirring the abrasive solution for polishing the work piece; and turning on the electromagnet magnetic controller to generate an alternating polarity magnetic field to cause the magnetic material to move in alternating directions.

7. The polishing method according to claim 6, wherein the parameters comprise the material and sizes of the abrasive grains, the concentration of the abrasive grains in the abrasive solution, the size and shape of the internal side of the ring, the type and rotational rate of the stirring element, the fabrication gap and the fabrication time.

* * * * *